United States Patent [19]

Andriotis

[11] 4,261,102

[45] Apr. 14, 1981

[54] HAIR CUTTING APPLIANCE

[76] Inventor: Demetrios Andriotis, 19 Alden Ave., Trumbull, Conn. 06611

[21] Appl. No.: 101,432

[22] Filed: Dec. 10, 1979

[51] Int. Cl.[3] ..... B26B 29/00

[52] U.S. Cl. ..... 30/133

[58] Field of Search ..... 30/131, 133

[56] References Cited

U.S. PATENT DOCUMENTS

| | | | |
|---|---|---|---|
| 3,606,681 | 9/1971 | Rogers | 30/133 |
| 3,979,825 | 9/1976 | Baumann | 30/133 |
| 4,000,562 | 1/1977 | Alevras | 30/133 |
| 4,005,526 | 2/1977 | Clay | 30/133 |

*Primary Examiner*—Jimmy C. Peters

*Attorney, Agent, or Firm*—Cifelli & Frederick

[57] ABSTRACT

A hair cutting appliance comprises a power-driven user-controlled scissors mounted in the cutting chamber of a housing. The scissors are driven in cutting strokes by solenoids. The housing also defines an exhaust chamber, and has a tubular handle adapting the exhaust chamber for connection to a source of suction via a flexible hose. Spacer means are mounted to the housing surrounding an inlet opening to the cutting chamber, and the spacer means may comprise several removably mounted spacer members of differing lengths for selecting a desired hair length. Hair is drawm into the cutting chamber in a path between the blades of the scissors, and the scissors is operated to cut the hair at the length determined by the spacer means. The housing is at least partially transparent so that the cutting of the hair can be seen by the user.

15 Claims, 5 Drawing Figures

41
40
26
29
10
SUCTION
45
85
21
20
39
23
25
90
70
86
87

39
28
20
24
80
28
26
40
51
37
22
50
81
3
53
3
56
88
85
54
60
78
25
95
90
52
27
55
28
28
23
76
10
70
79
29
86

Fig. 3.
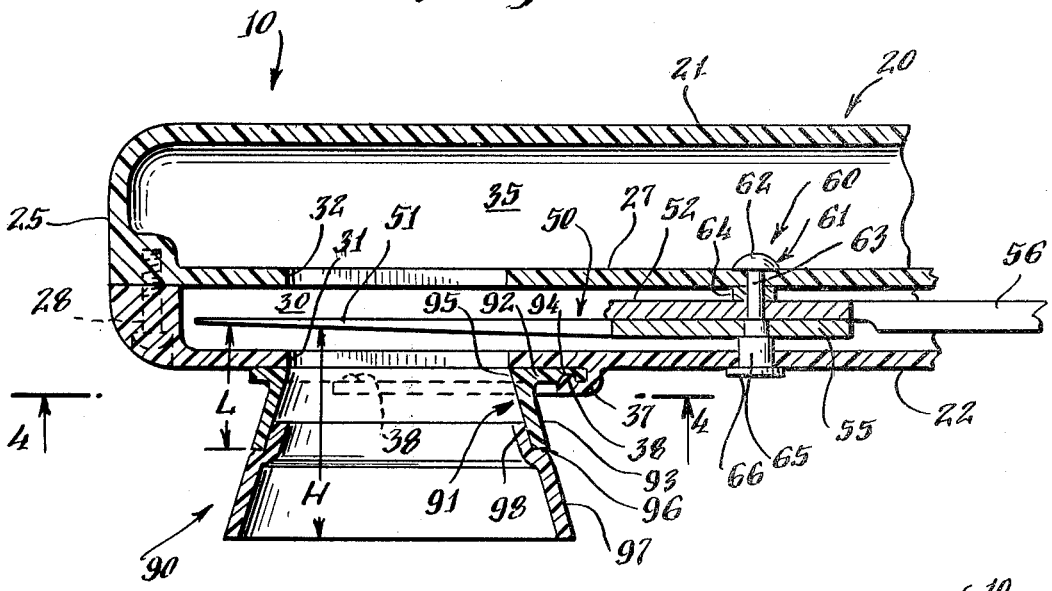
Fig. 4.
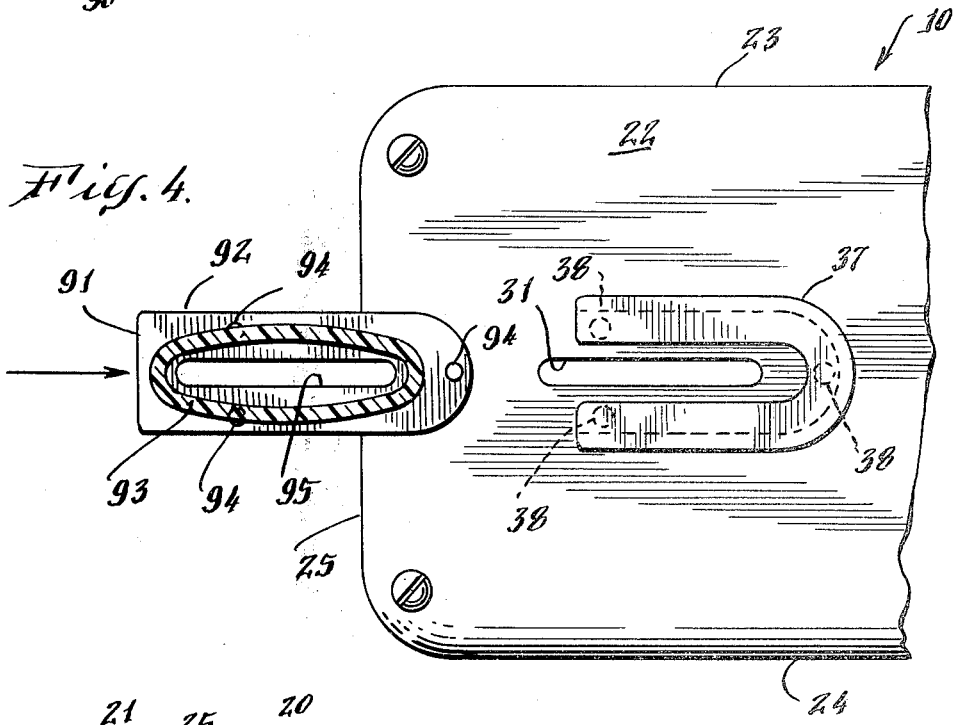
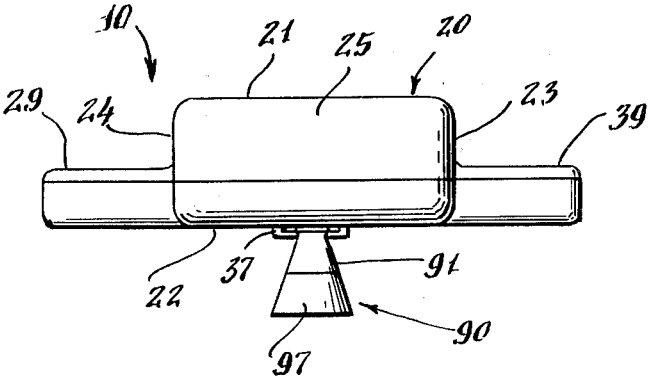
Fig. 5.

HAIR CUTTING APPLIANCE

BACKGROUND OF THE INVENTION

This invention relates to a hair cutting appliance for automatically and evenly cutting hair at a selectable length and for disposing of the cut hairs.

It is desirable to have a hair cutting appliance which will automatically and evenly cut hair to a selectable length, so that hair cuts can be given at home by those unskilled in the barber trade. Barbers may also find such a hair cutting appliance useful, as it may reduce both the time required to give a haircut and also be highly accurate as to length. It is further desirable that the hair cutting appliance remove cut hairs, whereby the haircut does not result in cut hairs being deposited on the clothing of the subject and on the floor surrounding the subject.

There are several prior art devices for cutting hair which have not been entirely successful. The first type of hair cutting apparatus includes a power operated clipper having reciprocating multi-toothed blades mounted in a housing to which suction is applied. The clipper teeth are spaced from the end of the housing to determine hair length. The suction draws the hair into the housing where the clipper is located, with the object being to have the clipper cut the hair. Devices of this type are disclosed in U.S. Pat. Nos. 4,077,122; 3,979,825; 3,654,699; and 1,331,218. The basic problem with these devices is that it is highly difficult to force the hair into the reciprocating multi-toothed clipper, with the result that the hair is unevenly cut. U.S. Pat. No. 1,735,766 discloses a somewhat similar device with the exception that the clipper is manually operated, and U.S. Pat. No. 2,807,086 discloses the use of a power operated clipper with a suction device for removing cut hair, but there is no provision for cutting hair to a uniform length. It has also been proposed to use rotary cutter blades within a suction chamber, wherein the chamber spaces the rotary cutter blades from the head of the subject. Devices of this type are shown in U.S. Pat. Nos. 3,900,949 and 1,238,061. However, the rotary cutter blades also do not achieve even cutting of the hair.

A suction tube has also been mounted to a manually operated scissors in order to remove cut hairs in devices according to U.S. Pat. Nos. 3,606,681 and 3,505,732, but these devices do not provide for cutting hair to a uniform length. U.S. Pat. No. 4,000,562 illustrates the use of a suction tube provided with a slot, whereby a manually operated scissors can cut hairs presented to the slot at a uniform length. This is not a simple operation inasmuch as it requires two hands and also does not produce a particularly even cut. A power operated scissors is shown in U.S. Pat. No. 2,945,298, but the scissors operates at a very high rate which would not be suitable for cutting hair, and is not incorporated into any type of hair cutting apparatus.

Accordingly, there exists a need for a hair cutting appliance which will satisfy the following objects of the invention herein.

SUMMARY OF THE INVENTION

It is a principal object of the invention herein to provide an improved hair cutting appliance.

It is an additional object of the invention herein to provide a hair cutting appliance which cuts hair evenly at a selected length and removes cut hairs.

It is a further object of the invention herein to provide a hair cutting appliance which is easy and efficient to use.

It is yet another object of the invention herein to provide a hair cutting appliance which is rugged and reliable in operation.

The hair cutting appliance according to the invention herein is characterized by a power-driven user-controlled scissors, the scissors being mounted in a cutting chamber defined by a housing of the hair cutting appliance. The housing further defines an exhaust chamber adapted to be connected to a source of suction, and a hollow tubular handle member extending from the housing conveniently provides means for holding and manipulating the hair cutting appliance as well as connecting with a flexible hose leading to the source of suction. The housing further defines an elongated inlet opening to the cutting chamber and an elongated outlet opening from the cutting chamber to the exhaust chamber, the inlet and outlet openings being aligned with each other. The scissors is mounted in the cutting chamber, and the scissors blades are power driven from an open position in which the cutting edges of the scissors blades flank a path extending between the inlet and outlet openings to a closed position with the blades together, such movement providing a severing scissors stroke across the path. The scissors are preferably powered by a pair of solenoids mounted within the housing, each solenoid acting on a respective one of the handle ends of the scissors blades. The solenoids are user-controlled by a button switch and operate simultaneously to provide a quick, clean cutting stroke of the scissors. Spacer means for determining the length at which the subject's hair is cut are removably attached to the housing, and preferably comprise a hollow tubular spacer member positioned over the inlet opening to the cutting chamber. Several such spacer members may be provided for selection by the user, and additional spacer extensions are telescopingly engaged on the spacer members to selectably increase the overall length at which the hair will be cut. The housing is preferably fabricated of a clear plastic material, so that the interior thereof may be viewed while operating the hair cutting appliance.

In using the hair cutting appliance, the source of suction is activated and the end of the spacer means is applied against the subject's head. Hair is drawn through the spacer means, through the inlet opening and into the cutting chamber, and if the hair is sufficiently long, also through the outlet opening of the cutting chamber. The user then activates the power-driven scissors to cut the hair to a uniform length. The hair cutting appliance is moved about the head of the subject until all of the hair has been cut. The cut hair ends are removed from the exhaust chamber to the source of suction as the hair is cut.

Other features and objects of the invention herein will in part be obvious and will in part appear from a perusal of the following description of the preferred embodiment and claims, taken together with the drawings.

DRAWINGS

FIG. 3 is a sectional view of the hair cutting appliance of FIG. 1 taken along the lines 3—3 of FIG. 2;

FIG. 4 is a fragmentary bottom plan view of the hair cutting appliance of FIG. 1 showing a spacer member being attached thereto; and FIG. 5 is an end view of the hair cutting appliance of FIG. 1.

The same reference numerals refer to the same elements throughout the various Figures.

DESCRIPTION OF PREFERRED EMBODIMENT

Figure 1:
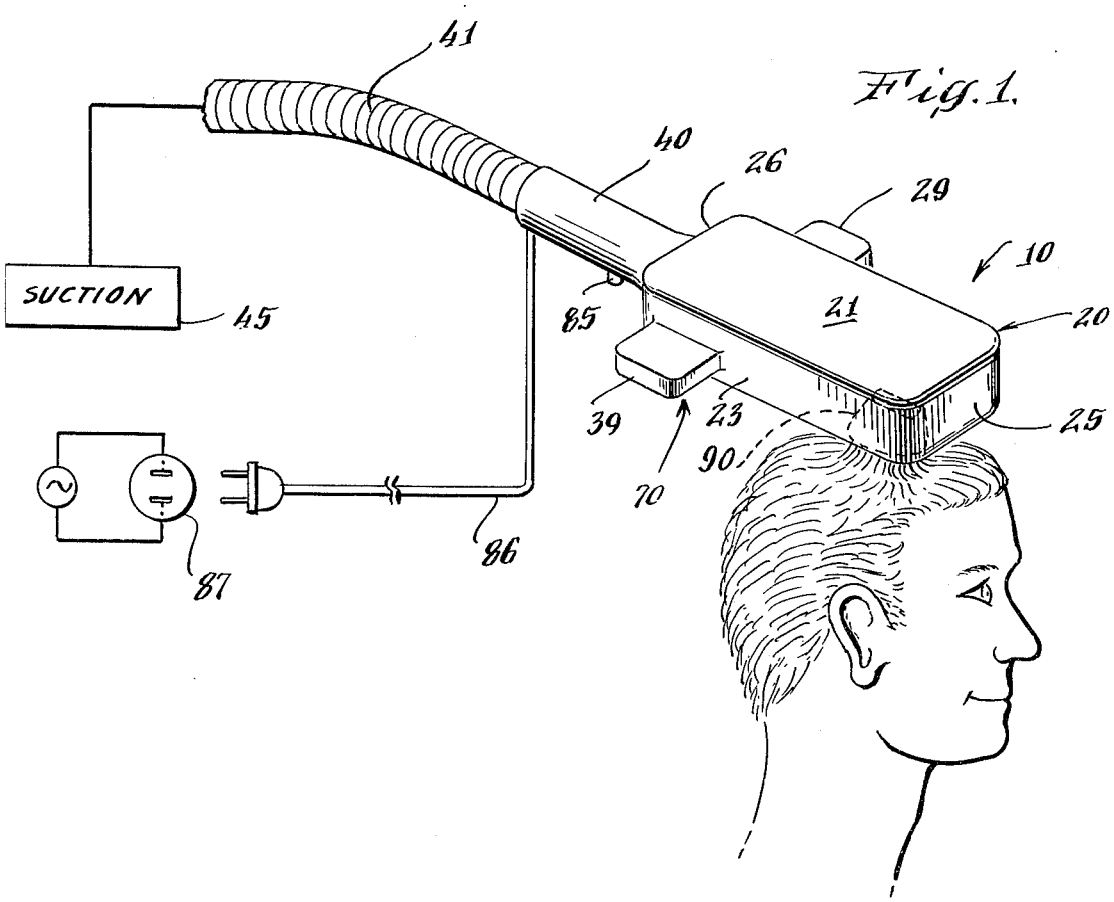
FIG. 1 is a perspective view of a hair cutting appliance according to the invention herein being utilized to cut a subject's hair.
Figure 2:
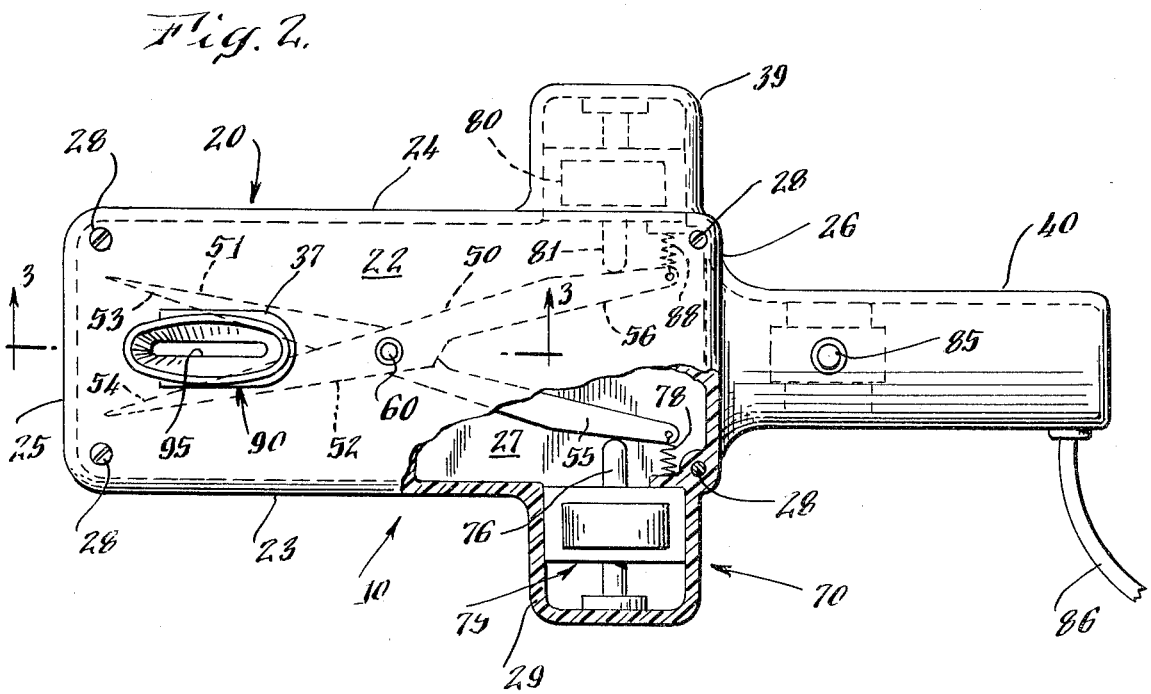
FIG. 2 is a bottom plan view, partially cut away, of the hair cutting appliance of FIG. 1.

FIG. 1 shows a hair cutting appliance 10 according to the invention herein being used to cut a subject's hair. As will become more clear in the following description of the preferred embodiment, the hair cutting appliance 10 generally comprises a housing 20 having a handle 40 extending therefrom, the handle 40 being adapted for connection to a source of suction. A scissors 50 is mounted in a cutting chamber within the housing 20, with drive means 70 providing for power-driven operation of the scissors under the control of the user. Spacer means 90 are attached to the housing 20 for determining the length at which the subject's hair will be cut. The suction, applied through the housing, draws the subject's hair through the spacer means 90 and also through openings into the housing, positioning the hair between the blades of the scissors 50, whereby operation of the scissors cuts the hair evenly at a selected length. The hair cutting appliance 10 is moved about the head of the subject to cut the hair, as required.

The housing 20 is preferably an elongated generally rectangular structure including a top wall 21, a bottom wall 22, opposed sidewalls 23 and 24, a forward wall 25 and a rear wall 26. The housing 20 further comprises pods 29 and 39 respectively projecting outwardly from the sidewalls 23 and 24, the pods 29 and 39 being provided to house portions of the power drive means 70, as will be more fully discussed below. The walls and pods are preferably joined at rounded corners so that the housing 20 has a smooth exterior.

As best seen in FIG. 3, an intermediate panel 27, which is generally parallel to the top and bottom walls 21, 22, divides the interior of the housing 20 into a cutting chamber 30 and an exhaust chamber 35. A tubular handle 40 extends from the rear wall 26, the hollow interior of the tubular handle 40 opening into the exhaust chamber 35. The tubular handle 40 is adapted to be connected to a source of suction (such as a household vacuum cleaner), generally indicated at 45 in FIG. 1, via a flexible hose 41.

The housing is preferably fabricated in two pieces, again as best seen in FIG. 3, with the top wall 21, intermediate panel 27 and upper portions of the peripheral walls being formed in one piece and the bottom wall 22 and lower portions of the peripheral walls being formed in an additional piece secured to the first piece by screws 28. This provides access to the cutting chamber 30 for repair or replacement of the scissors 50 or for cleaning, if required. The housing is preferably fabricated of a plastic material and at least a portion of the housing is transparent such that the interior of the cutting chamber may be observed by the user.

The scissors 50 is mounted in the cutting chamber 30 of the housing 20. The scissors 50 comprises blades 51 and 52 having cutting edges 53 and 54, respectively. Blades 51 and 52 also respectively have integral handle extensions 55 and 56. The blades 51 and 52 are secured together in the usual pivotal arrangement by a bolt assembly 60, which also serves to mount the scissors 50 in the housing 20. More particularly, the bolt assembly 60 includes a bolt 61 having a head 62 disposed on the upper side of panel 27 with the shank 63 of the bolt extending through an opening provided in the panel 27. A spacer 64, which may be a nut or a collar secured to the shank 63, mounts the bolt to panel 27 and also spaces blades 51, 52 from panel 27. The blades 51 and 52 have openings through which the shank of the bolt 61 passes, and a nut 65 secures the blades together. The nut 65 extends through the bottom wall 22 and also preferably includes a flange 66 which rests against the bottom wall 22, whereby the scissors is securely mounted and positioned in the cutting chamber 30 of housing 20, disposed for cutting action.

Power drive means 70 of the hair cutting appliance 10 serves to operate the scissors 50 in quick, strong cutting strokes under the control of the user. The power drive means generally comprises two solenoids 75 and 80, solenoid 75 being mounted in the housing pod 29 and solenoid 80 being mounted in the housing pod 39. The plunger 76 of the solenoid 75 bears against the handle end 55 of the scissors blade 51, and the plunger 81 of solenoid 80 bears against the handle 56 of the scissors blade 52. The solenoids 75 and 80 are operated under user control via a button switch 85 interposed in a power cord 86 which plugs into a standard electrical outlet, as indicated at 87. The button switch 85 is mounted in the handle 40 of the hair cutting appliance 10 with the button itself extending through the handle, and the button is preferably located on the underside of handle 40 so that the user may grasp the handle to manipulate the hair cutting appliance 10 and may operate the button switch 85 with one finger and without releasing his grasp on the handle 40. It will be appreciated that when the button switch 85 is depressed to provide power to the solenoids 75 and 80, their plungers 76 and 81 are driven inwardly, thereby forcing the handle ends 55 and 56 and thereby also the blades 51 and 52 together in a cutting stroke. The cutting action is "single-stroke" for each closing of button switch 85. A pair of return springs 78 and 88 are mounted, respectively, to the handle ends 55 and 56 of the scissors 50. The return springs 78 and 88 serve to open the scissors 50 upon completion of a cutting stroke and also to maintain the handle ends of the scissors biased against the plungers of the solenoids 75, 80.

The cutting chamber 30 is provided with an entry slot opening 31 and an exit slot opening 32, the slot openings being positioned to admit and orient the subject's hair for cutting by the scissors 50. More particularly, and with reference to FIGS. 3 and 4, the entry slot opening 31 is defined in the bottom wall 22. The entry slot opening is elongated and lies along the general axis of the scissors blades 51 and 52 (when closed together), being disposed between and below the scissors blades 51 and 52 when the scissors blades are open. The exit slot opening 32 is defined by the intermediate panel 27 separating the cutting chamber 30 from the exhaust chamber 35. The exit slot opening 32 is also elongated and it is aligned with the entry slot opening 31. Thus, a "path" between the entry slot opening 31 and the exit slot opening 32 passes between the scissors blades 51 and 52 when they are open, and when the scissors blades are forced together in a cutting stroke, they sever the path between the entry slot opening 31 and the exit slot opening 32.

The length at which the hair cutting appliance 10 cuts the subject's hair is determined by spacer means 90, and in the preferred embodiment, provision for cutting hair at a plurality of selectable lengths is made. The spacer means 90 preferably comprises a spacer member 91 having a base plate 92 and an integral spacer wall 93. The base plate 92 is detachably mounted to the bottom wall 22 of the housing, and more particularly, the bottom wall 22 is provided with a U-shaped flange 37 which slidingly receives the base plate 92. The base plate has a plurality of depressions 94 which receive bumps 38 of the flange 37 in an interengaging fit, thereby positioning and holding the spacer member 91 on the housing 20. The base plate 92 defines an elongated opening 95, which is shaped to register with the entry opening 31 into the cutting chamber 30. The spacer wall 93 is generally oval in cross-section, surrounding the opening 95 in the base plate 92 and extends outwardly in a flare from the base plate 92 to its terminus at 96.

The spacer member 91 alone provides for cutting the subject's hair to a length L as best illustrated in FIG. 3. In order to provide for cutting the subject's hair to a greater length H, a spacer extension 97 is provided. The spacer extension 97 is also generally tubular with an oval cross section, and has a necked-down portion 98 which slides into the end of the spacer member 91 to mount the spacer extension via a friction fit. Interengaging protrusions, not shown, may be provided to assist in securing the spacer extension 97. It will be appreciated that spacer members 91 of various lengths as well as spacer extensions 97 of various lengths may be employed in order to provide selection among a number of possible hair lengths, the user selecting the desired hair lengths by placing the appropriate spacer members (and spacer extensions) in position on the housing 20. It will be appreciated that the spacer means could be integral with the housing 20, or that a "short length" spacer member could be integral with the housing and utilized with selected spacer extensions.

In using the hair cutting appliance 10, the desired spacer means 90 are positioned on the housing 20, the power cord 86 is plugged in and the source of suction 45 is activated. The user grasps the handle 40 and places the terminal end of the spacer means 90 against the subject's head. A portion of the subject's hair is sucked through the spacer means, through the entry slot opening 31 and into the cutting chamber 30, lying in a path between the open blades 51 and 52 of the scissors 50. If the subject's hair is sufficiently long, it will also be sucked through the exit slot opening 32 of the cutting chamber 30 and into the exhaust chamber 35. The user can observe the positioning of the hair between the scissors blades through the clear portion of the housing 20, and when the hair is positioned between the scissors, the user depresses the button switch 85. This causes the solenoids 75 and 80 to impart a cutting stroke to the blades 51 and 52 of the scissors. An additional cutting stroke may be utilized, if it appears necessary. The hair is cut cleanly and evenly by the scissors, and the severed hair ends are removed through the exhaust chamber 35, the handle 40, the flexible hose 41 to the source of suction 45, which may employ a collection device. The hair cutting appliance 10 is moved about the head of the subject until all of the hair has been cut satisfactorily.

Accordingly, there has been described a hair cutting appliance which admirably achieves the objects of the invention herein. It will be appreciated that the above description of a preferred embodiment is illustrative only, and that various changes may be made by those skilled in the art without departing from the spirit and scope of the invention, which is limited only by the following claims.

I claim:

1. A hair cutting appliance for cutting hair on a subject's head, the hair cutting appliance comprising:

A. a housing defining a cutting chamber and an exhaust chamber, the exhaust chamber adapted for connection to a source of suction, the housing further defining an inlet opening to the cutting chamber and an outlet opening from the cutting chamber to the exhaust chamber;

B. a scissors mounted in the cutting chamber, the scissors including two cutting blades pivotally secured together and movable from an open position with the blades flanking a path between the inlet and outlet openings to a closed position in a cutting stroke across the path;

C. power drive means for closing the scissors in a cutting stroke, including switch means for activating the power drive means; and D. spacer means at least partially surrounding the inlet opening and extending outwardly from the housing, the spacer means being adapted to be applied to the subject's head and thereby space the cutting blades of the scissors a predetermined distance therefrom, whereby when the spacer means is applied to the subject's head, a portion of the subject's hair is drawn through the spacer means and entry opening and is positioned between the cutting blades of the scissors, and the power drive means are activated to operate the scissors in a cutting stroke to evenly sever the subject's hair, the source of suction removing the cut hair ends.

2. A hair cutting appliance as defined in claim 1 wherein the inlet and outlet openings of the cutting chamber are elongated slot openings aligned with each other and aligned along the length of the scissors blades when the scissors blades are closed together.

3. A hair cutting appliance as defined in claim 1 wherein the power drive means for closing the scissors in a cutting stroke comprises a pair of solenoids mounted in the housing, each solenoid acting on a respective one of the scissors blades to force the scissors blades together in a cutting stroke.

4. A hair cutting appliance as defined in claim 3 wherein the scissors blades have handle extensions comprising integral extensions of the cutting blades on the opposite side of the point at which the cutting blades are pivotally secured together, and the solenoids act on the handle extensions to close the scissors blades together in a cutting stroke.

5. A hair cutting appliance as defined in claim 4 and further comprising return spring means acting to open the scissors blades following a cutting stroke.

6. A hair cutting appliance as defined in claim 1 wherein the housing further comprises a handle extending outwardly therefrom, the handle being hollow and opening into the exhaust chamber defined by the housing, and the handle being adapted for connecting the exhaust chamber to the source of suction by a flexible hose.

7. A hair cutting appliance as defined in claim 6 wherein the switch means for activating the power drive means is a button switch mounted with its button on the exterior of the handle.

8. A hair cutting appliance as defined in claim 1 wherein at least a portion of the housing is transparent, thereby permitting a view of the scissors blades prior to cutting hair disposed therebetween.

9. A hair cutting appliance as defined in claim 2 wherein the scissors blades have handle extensions comprising integral extensions of the cutting blades on the opposite side of the point at which the cutting blades are pivotally secured together, the power drive means for closing the scissors in a cutting stroke comprises a pair of solenoids mounted in the housing, each solenoid acting on the handle extension of a respective one of the scissors blades to force the scissors blades together in a cutting stroke, and further comprising return spring means acting to open the scissors blades following a cutting stroke.

10. A hair cutting appliance as defined in claim 9 wherein the housing further comprises a handle extending outwardly therefrom, the handle being hollow and opening into the exhaust chamber defined by the housing and the handle being adapted for connecting the exhaust chamber to the source of suction by a flexible hose, and wherein the switch means for activating the power drive means is a button switch mounted with its button on the exterior of the handle.

11. A hair cutting appliance as defined in claim 10 wherein at least a portion of the housing is transparent, thereby permitting a view of the scissors blades prior to cutting hair disposed therebetween.

12. A hair cutting appliance as defined in claim 11 wherein the spacer means comprises a spacer member having a base plate slidingly received and removably retained in a U-shaped flange of the housing, the base plate defining an opening registering with the entry opening to the cutting chamber, and a spacer wall extending outwardly from the base plate, and entry opening defined by the housing to a terminal end for application to the subject's head, the length of the spacer wall determining the length at which the subject's hair will be cut.

13. A hair cutting appliance as defined in claim 12 wherein the spacer means further comprises a spacer extension which is removably secured to the spacer wall of the spacer member, the spacer extension extending further outwardly from the entry opening defined by the housing and thereby increasing the length at which the subject's hair will be cut.

14. A hair cutting appliance as defined in claim 1 wherein the spacer means comprises a spacer member having a base plate slidingly received and removably retained in a U-shaped flange of the housing, the base plate defining an opening registering with the entry opening to the cutting chamber, and a spacer wall extending outwardly from the base plate, and entry opening defined by the housing to a terminal end for application to the subject's head, the length of the spacer wall determining the length at which the subject's hair will be cut.

15. A hair cutting appliance as defined in claim 14 wherein the spacer means further comprises a spacer extension which is removably secured to the spacer wall of the spacer member, the spacer extension extending further outwardly from the entry opening defined by the housing and thereby increasing the length at which the subject's hair will be cut.

* * * * *